US007891503B2

(12) United States Patent
Hardy

(10) Patent No.: US 7,891,503 B2
(45) Date of Patent: Feb. 22, 2011

(54) PRODUCT MANAGEMENT DISPLAY SYSTEM

(75) Inventor: Stephen N. Hardy, Wadsworth, OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 0 days.

(21) Appl. No.: 11/465,936

(22) Filed: Aug. 21, 2006

(65) Prior Publication Data

US 2007/0095772 A1 May 3, 2007

Related U.S. Application Data

(63) Continuation of application No. 11/216,493, filed on Aug. 31, 2005, now Pat. No. 7,093,546, which is a continuation of application No. 10/474,490, filed on Oct. 8, 2003, now Pat. No. 6,964,235.

(51) Int. Cl.
*A47F 7/00* (2006.01)

(52) U.S. Cl. ..... 211/59.3

(58) Field of Classification Search ..... 211/59.3, 211/183, 43, 11, 51; 108/61, 60, 108; 312/61, 312/71; 206/817

See application file for complete search history.

(56) References Cited

U.S. PATENT DOCUMENTS

| | | | |
|---|---|---|---|
| 154,940 | A | 9/1874 | Adams |
| 355,511 | A | 1/1887 | Danner |
| 632,231 | A | 9/1899 | Blades |
| 808,067 | A | 12/1905 | Briggs |
| 847,863 | A | 3/1907 | Watts |
| 1,156,140 | A | 10/1915 | Hair |
| 1,703,987 | A | 3/1929 | Butler |
| 1,712,080 | A | 5/1929 | Kelly |
| 1,714,266 | A | 5/1929 | Johnson |

(Continued)

FOREIGN PATENT DOCUMENTS

| | | |
|---|---|---|
| BE | 906083 | 4/1987 |

(Continued)

OTHER PUBLICATIONS

FFR Yellow Pages® 2003 Product Catalog, "Merchandising Ideas Made Easy for Every Retail Environment!", Cover pp. 9-11, 48-49, 52-58, Back Cover.

(Continued)

*Primary Examiner*—Sarah Purol
(74) *Attorney, Agent, or Firm*—Banner & Witcoff, Ltd.

(57) ABSTRACT

An integrated "T" assembly combines into a single integrated assembly, a track portion along both sides of a divider. The T assembly may have a wide-base portion, which may include a spring-urged-pusher track, on one side of the divider and a narrow-base portion on the opposite side of the divider. An offset pusher may have an upper portion that is offset, via an angled offset portion, from a lower portion of the pusher. Additional supporting bases, any of which may include spring-urged-pusher tracks and/or a spring-urged pusher, may be used under a wide product. Left and right side finisher components may be paired with T assemblies near the sides of a merchandise-display shelf. The T assembly, base, and/or end finishers may be coupled to a front rail via a complimentary tongue and groove arrangement and/or a non-slidable engagement.

42 Claims, 12 Drawing Sheets

U.S. PATENT DOCUMENTS

| | | | |
|---|---|---|---|
| 1,734,031 | A | 11/1929 | Carlson |
| 1,786,392 | A | 12/1930 | Kemp |
| 1,964,597 | A | 6/1934 | Rapellin |
| 1,971,749 | A | 8/1934 | Hamilton |
| 1,991,102 | A | 2/1935 | Kernaghan |
| 2,057,627 | A | 10/1936 | Ferris |
| 2,079,754 | A | 5/1937 | Waxgiser |
| 2,085,479 | A | 6/1937 | Shaffer et al. |
| 2,110,299 | A | 3/1938 | Hinkle |
| 2,111,496 | A | 3/1938 | Scriba |
| 2,129,122 | A | 9/1938 | Follett |
| 2,218,444 | A | 10/1940 | Vineyard |
| 2,499,088 | A | 2/1950 | Brill et al. |
| 2,516,122 | A | 7/1950 | Hughes |
| 2,555,102 | A | 5/1951 | Anderson |
| 2,563,570 | A | 8/1951 | Williams |
| 2,652,154 | A | 9/1953 | Stevens |
| 2,670,853 | A | 3/1954 | Schneider |
| 2,678,045 | A | 5/1954 | Erhard |
| 2,738,881 | A | 3/1956 | Michel |
| 2,750,049 | A | 6/1956 | Hunter |
| 2,775,365 | A | 12/1956 | Mestman et al. |
| 2,893,596 | A | 7/1959 | Gabrielsen |
| 2,918,295 | A | 12/1959 | Milner |
| 2,934,212 | A | 4/1960 | Jacobson |
| 2,948,403 | A | 8/1960 | Vallez |
| 3,083,067 | A | 3/1963 | Vos et al. |
| 3,103,396 | A | 9/1963 | Portnoy |
| 3,151,576 | A | 10/1964 | Patterson |
| 3,161,295 | A | 12/1964 | Chesley |
| 3,166,195 | A | 1/1965 | Taber |
| 3,285,429 | A | 11/1966 | Propst |
| 3,308,961 | A | 3/1967 | Chesley |
| 3,308,964 | A | 3/1967 | Pistone |
| 3,348,732 | A | 10/1967 | Schwarz |
| 3,405,716 | A | 10/1968 | Cafiero et al. |
| 3,452,899 | A | 7/1969 | Libberton |
| 3,497,081 | A | 2/1970 | Field |
| 3,501,020 | A | 3/1970 | Krikorian |
| D219,058 | S | 10/1970 | Kaczur |
| 3,550,979 | A | 12/1970 | Protzmann |
| 3,598,246 | A | 8/1971 | Galli |
| 3,652,154 | A | 3/1972 | Gebel |
| 3,667,826 | A | 6/1972 | Wood et al. |
| 3,698,568 | A | 10/1972 | Armstrong |
| 3,709,371 | A | 1/1973 | Luck |
| 3,751,129 | A | 8/1973 | Wright et al. |
| 3,814,490 | A | 6/1974 | Dean et al. |
| 3,815,519 | A | 6/1974 | Meyer |
| 3,830,169 | A | 8/1974 | Madey |
| 3,836,008 | A | 9/1974 | Mraz |
| 3,848,745 | A | 11/1974 | Smith |
| 3,868,021 | A | 2/1975 | Heinrich |
| 3,870,156 | A | 3/1975 | O'Neill |
| 4,007,841 | A | 2/1977 | Seipel |
| 4,042,096 | A | 8/1977 | Smith |
| 4,106,668 | A | 8/1978 | Gebhardt et al. |
| 4,269,326 | A | 5/1981 | Delbrouck |
| 4,300,693 | A | 11/1981 | Spamer |
| 4,303,162 | A | 12/1981 | Suttles |
| 4,314,700 | A | 2/1982 | Dylag |
| 4,331,243 | A | 5/1982 | Doll |
| 4,351,439 | A | 9/1982 | Taylor |
| 4,378,872 | A | 4/1983 | Brown |
| 4,448,653 | A | 5/1984 | Wegmann |
| 4,454,948 | A | 6/1984 | Spamer |
| 4,460,096 | A | 7/1984 | Ricci |
| 4,463,854 | A | 8/1984 | MacKenzie |
| 4,467,927 | A | 8/1984 | Nathan |
| 4,482,066 | A | 11/1984 | Dykstra |
| 4,488,653 | A | 12/1984 | Belokin |
| 4,504,100 | A | 3/1985 | Chaumard |
| 4,588,093 | A | 5/1986 | Field |
| 4,589,349 | A | 5/1986 | Gebhardt et al. |
| 4,602,560 | A | 7/1986 | Jacky |
| 4,615,276 | A | 10/1986 | Garabedian |
| 4,620,489 | A | 11/1986 | Albano |
| 4,629,072 | A | 12/1986 | Loew |
| 4,651,883 | A | 3/1987 | Gullett et al. |
| 4,685,574 | A | 8/1987 | Young et al. |
| 4,705,175 | A | 11/1987 | Howard et al. |
| 4,706,821 | A | 11/1987 | Kohls et al. |
| 4,724,968 | A | 2/1988 | Wombacher |
| 4,729,481 | A | 3/1988 | Hawkinson et al. |
| 4,730,741 | A | 3/1988 | Jackle, III et al. |
| 4,742,936 | A | 5/1988 | Rein |
| 4,762,235 | A | 8/1988 | Howard et al. |
| 4,762,236 | A | 8/1988 | Jackle, III et al. |
| 4,775,058 | A | 10/1988 | Yatsko |
| 4,776,472 | A | 10/1988 | Rosen |
| 4,790,037 | A | 12/1988 | Phillips |
| 4,809,856 | A | 3/1989 | Muth |
| 4,828,144 | A | 5/1989 | Garrick |
| 4,830,201 | A | 5/1989 | Breslow |
| 4,836,390 | A | 6/1989 | Polvere |
| 4,846,367 | A | 7/1989 | Guigan et al. |
| 4,883,169 | A | 11/1989 | Flanagan, Jr. |
| 4,899,668 | A | 2/1990 | Valiulis |
| 4,901,853 | A | 2/1990 | Maryatt |
| 4,901,869 | A | 2/1990 | Hawkinson et al. |
| 4,907,707 | A | 3/1990 | Crum |
| 4,934,645 | A | 6/1990 | Breslow |
| 5,012,936 | A | 5/1991 | Crum |
| 5,025,936 | A | 6/1991 | Lamoureaux |
| 5,027,957 | A | 7/1991 | Skalski |
| 5,082,125 | A | 1/1992 | Ninni |
| 5,088,607 | A | 2/1992 | Risafi et al. |
| 5,110,192 | A | 5/1992 | Lauterbach |
| 5,111,942 | A | 5/1992 | Bernardin |
| 5,123,546 | A | 6/1992 | Crum |
| 5,148,927 | A | 9/1992 | Gebka |
| 5,161,702 | A | 11/1992 | Skalski |
| 5,178,258 | A | 1/1993 | Smalley |
| 5,183,166 | A | 2/1993 | Belokin, Jr. et al. |
| 5,190,186 | A | 3/1993 | Yablans et al. |
| 5,203,463 | A | 4/1993 | Gold |
| 5,215,199 | A | 6/1993 | Bejarano |
| 5,255,802 | A | 10/1993 | Krinke et al. |
| 5,265,738 | A | 11/1993 | Yablans et al. |
| 5,316,154 | A | 5/1994 | Hajec, Jr. |
| 5,341,945 | A | 8/1994 | Gibson |
| 5,351,839 | A | 10/1994 | Beeler et al. |
| 5,366,099 | A | 11/1994 | Schmid |
| 5,381,908 | A | 1/1995 | Hepp |
| 5,390,802 | A | 2/1995 | Pappagallo et al. |
| 5,413,229 | A | 5/1995 | Zuberbuhler et al. |
| 5,415,297 | A | 5/1995 | Klein et al. |
| 5,450,969 | A | 9/1995 | Johnson et al. |
| 5,458,248 | A | 10/1995 | Alain |
| 5,464,105 | A | 11/1995 | Mandeltort |
| 5,469,975 | A | 11/1995 | Fajnsztajn |
| 5,469,976 | A | 11/1995 | Burchell |
| 5,542,552 | A | 8/1996 | Yablans et al. |
| 5,562,217 | A | 10/1996 | Salveson et al. |
| 5,613,621 | A | 3/1997 | Gervasi |
| D378,888 | S | 4/1997 | Bertilsson |
| 5,615,780 | A | 4/1997 | Nimetz et al. |
| 5,634,564 | A | 6/1997 | Spamer et al. |
| 5,638,963 | A | 6/1997 | Finnelly et al. |
| 5,665,304 | A | 9/1997 | Heinen et al. |
| 5,673,801 | A | 10/1997 | Markson |
| D386,363 | S | 11/1997 | Dardashti |
| 5,685,664 | A | 11/1997 | Parham et al. |
| 5,730,320 | A | 3/1998 | David |

| | | | | |
|---|---|---|---|---|
| 5,738,019 | A | 4/1998 | Parker | |
| 5,740,944 | A | 4/1998 | Crawford | |
| 5,743,428 | A | 4/1998 | Rankin, VI | |
| 5,746,328 | A | 5/1998 | Beeler et al. | |
| 5,788,090 | A | 8/1998 | Kajiwara | |
| 5,803,276 | A | 9/1998 | Vogler | |
| 5,826,731 | A | 10/1998 | Dardashti | |
| 5,839,588 | A | 11/1998 | Hawkinson | |
| 5,855,283 | A | 1/1999 | Johnson | |
| 5,873,473 | A | 2/1999 | Pater | |
| 5,878,895 | A | 3/1999 | Springs | |
| 5,906,283 | A | 5/1999 | Kump et al. | |
| 5,971,204 | A | 10/1999 | Apps | |
| 6,006,678 | A | 12/1999 | Merit | |
| 6,041,720 | A | 3/2000 | Hardy | |
| 6,082,557 | A | 7/2000 | Leahy | |
| 6,112,938 | A | 9/2000 | Apps | |
| 6,129,218 | A | 10/2000 | Henry et al. | |
| 6,142,317 | A | 11/2000 | Merl | |
| 6,164,491 | A | 12/2000 | Bustos et al. | |
| 6,173,845 | B1 | 1/2001 | Higgins et al. | |
| 6,209,733 | B1 | 4/2001 | Higgins et al. | |
| 6,227,385 | B1 | 5/2001 | Nickerson | |
| 6,234,325 | B1 | 5/2001 | Higgins et al. | |
| 6,234,326 | B1 | 5/2001 | Higgins et al. | |
| 6,234,328 | B1 | 5/2001 | Mason | |
| D445,615 | S | 7/2001 | Burke | |
| 6,253,954 | B1 | 7/2001 | Yasaka | |
| 6,357,606 | B1 | 3/2002 | Henry | |
| 6,382,431 | B1 | 5/2002 | Burke | |
| 6,389,991 | B1 | 5/2002 | Morrisson | |
| 6,401,942 | B1 | 6/2002 | Eckert | |
| 6,405,880 | B1 | 6/2002 | Webb | |
| 6,409,027 | B1 | 6/2002 | Chang et al. | |
| 6,409,028 | B2 | 6/2002 | Nickerson | |
| 6,464,089 | B1 | 10/2002 | Rankin, VI | |
| 6,484,891 | B2 | 11/2002 | Burke | |
| 6,497,326 | B1 | 12/2002 | Osawa | |
| 6,523,703 | B1 | 2/2003 | Robertson | |
| 6,527,127 | B2 | 3/2003 | Dumontet | |
| 6,533,131 | B2 * | 3/2003 | Bada | 211/59.2 |
| D472,411 | S | 4/2003 | Burke | |
| 6,598,754 | B2 | 7/2003 | Weiler | |
| 6,622,874 | B1 | 9/2003 | Hawkinson | |
| 6,655,536 | B2 * | 12/2003 | Jo et al. | 211/59.3 |
| 6,666,533 | B1 | 12/2003 | Stavros | |
| D485,699 | S | 1/2004 | Mueller et al. | |
| 6,772,888 | B2 | 8/2004 | Burke | |
| 6,866,156 | B2 | 3/2005 | Nagel et al. | |
| 6,886,699 | B2 | 5/2005 | Johnson et al. | |
| 6,889,854 | B2 | 5/2005 | Burke | |
| 6,948,900 | B1 | 9/2005 | Neuman | |
| 6,964,235 | B2 | 11/2005 | Hardy | |
| 7,216,770 | B2 | 5/2007 | Mueller | |
| 7,395,938 | B2 * | 7/2008 | Merit et al. | 211/59.4 |
| 7,458,473 | B1 | 12/2008 | Mason | |
| 7,614,350 | B2 * | 11/2009 | Tuttle et al. | 108/23 |
| 7,641,057 | B2 | 1/2010 | Mueller et al. | |
| 2001/0010302 | A1 | 8/2001 | Nickerson | |
| 2002/0036178 | A1 | 3/2002 | Tombu | |
| 2002/0108916 | A1 | 8/2002 | Nickerson | |
| 2002/0148794 | A1 | 10/2002 | Marihugh | |
| 2002/0170866 | A1 | 11/2002 | Johnson et al. | |
| 2003/0000956 | A1 | 1/2003 | Maldonado | |
| 2003/0010732 | A1 | 1/2003 | Burke | |
| 2003/0057167 | A1 | 3/2003 | Johnson et al. | |
| 2003/0061973 | A1 | 4/2003 | Bustos | |
| 2003/0085187 | A1 | 5/2003 | Johnson et al. | |
| 2003/0141265 | A1 | 7/2003 | Jo et al. | |
| 2003/0217980 | A1 * | 11/2003 | Johnson et al. | 211/59.3 |
| 2004/0104239 | A1 | 6/2004 | Black, Jr. et al. | |
| 2004/0140278 | A1 | 7/2004 | Mueller et al. | |
| 2004/0140279 | A1 | 7/2004 | Mueller et al. | |
| 2004/0245197 | A1 | 12/2004 | McElvaney | |
| 2006/0049122 | A1 | 3/2006 | Mueller et al. | |
| 2006/0163272 | A1 | 7/2006 | Gamble | |
| 2006/0186064 | A1 | 8/2006 | Merit et al. | |
| 2006/0237381 | A1 | 10/2006 | Lockwood et al. | |

FOREIGN PATENT DOCUMENTS

| | | | |
|---|---|---|---|
| CH | 412 251 | | 4/1966 |
| DE | 969003 | | 4/1958 |
| DE | 1819158 | | 7/1960 |
| DE | 2002720 | | 7/1971 |
| DE | 7311113 | | 8/1973 |
| DE | 2232398 | | 1/1974 |
| DE | 28 25 724 | A1 | 12/1979 |
| DE | 8308485 | | 9/1983 |
| DE | 8426651 | | 7/1985 |
| DE | 299 02 688 | | 7/1999 |
| EP | 0004921 | | 4/1979 |
| EP | 0018003 | | 7/1984 |
| EP | 0224107 | A2 | 11/1986 |
| EP | 270016 | | 6/1988 |
| EP | 0 337 340 | | 10/1989 |
| EP | 0408400 | A1 | 7/1990 |
| EP | 0 398 500 | A1 | 11/1990 |
| EP | 0 454 586 BA | | 10/1991 |
| EP | 0587059 | | 3/1994 |
| EP | 986980 | | 3/2000 |
| EP | 0 779 047 | B1 | 4/2000 |
| EP | 1395152 | | 2/2005 |
| EP | 0176209 | | 4/2008 |
| FR | 2 385 365 | | 10/1978 |
| FR | 2526338 | | 11/1983 |
| FR | 2617385 | | 1/1989 |
| GB | 697994 | | 10/1953 |
| GB | 740311 | | 11/1955 |
| GB | 881700 | | 11/1961 |
| GB | 1082150 | | 9/1967 |
| GB | 2 027339 | A | 2/1980 |
| GB | 2037553 | | 7/1994 |
| GB | 2281289 | | 1/1995 |
| GB | 2 283 407 | A | 5/1995 |
| GB | 2290077 | | 12/1995 |
| GB | 2297241 | A | 7/1996 |
| GB | 1088654 | | 11/2000 |
| GB | 2392667 | A | 10/2004 |
| JP | 54168195 | | 11/1979 |
| JP | 59 218113 | | 8/1984 |
| JP | 62060521 | A | 3/1987 |
| JP | 6329463 | | 2/1988 |
| JP | 02-191413 | | 7/1990 |
| JP | 6202945 | | 7/1994 |
| JP | 11342054 | | 12/1999 |
| JP | 2000157378 | | 6/2000 |
| JP | 2000350642 | | 12/2000 |
| JP | 2001104117 | | 4/2001 |
| JP | 2003210286 | | 7/2003 |
| NL | 106617 | | 11/1963 |
| NL | 8520125 | | 1/1986 |
| SE | 394537 | | 6/1977 |
| SU | 1600615 | | 10/1990 |
| WO | 91/15141 | A | 10/1991 |
| WO | 00 71004 | | 11/2000 |
| WO | 03/032775 | | 4/2003 |

OTHER PUBLICATIONS

*RTC Industries, Inc.*, v. *Fasteners for Retail, Inc., and SuperValu, Inc. d/b/a Cub Foods*, Complaint, Document 1, Case No. 05C 6940 filed Dec. 8, 2005.

*RTC Industries, Inc.*, v. *Fasteners for Retail, Inc., and SuperValu, Inc. d/b/a Cub Foods*, Stipulation of Dismissal, Civil Action No. 05 C 6940, Apr. 2006.

*RTC* vs. *Fasteners for Retail*, Case No. 05C 6940, Document No. 26, filed Apr. 25, 2006.
*RTC Industries, Inc.*, v. *Fasteners for Retail, Inc., and SuperValu, Inc. d/b/a Cub Foods*, Answer of Defendant Fasteners for Retail, Inc., Civil Action No. O5 C 6940, Document 20, filed Jan. 18, 2006.
*RTC Industries, Inc.*, v. *Fasteners for Retail, Inc., and SuperValu, Inc. d/b/a Cub Foods*, Stipulation of Dismissal, Civil Action No. 05 C 6940, Apr. 2006.
*RTC* vs. *Fasteners for Retail*, Case No. 05C 6940, Document No. 26, filed Apr. 25, 2006.
*RTC Industries, Inc.*, v. *HMG Worldwide Corporation*, Complaint, Civil Action No. 00C 3300, dated May 31, 2000.
*RTC Industries, Inc.* v. *HMG Worldwide Corporation*, Amended Complaint, dated Jan. 19, 2001.
*RTC Industries, Inc.* v. *HMG Worldwide Corporation*, RTC's Reply to HMG Worldwide Corporation's Amended Counterclaims, Civil Action No. 00 CV 3300, dated Mar. 7, 2001.
*RTC Industries, Inc.* v. *William Merit & Associates, Inc.*, Memorandum Opinion, Civil Action No. 04 C 1254, dated Jul. 15, 2004.
*RTC Industries, Inc.* v. *HMG Worldwide Corporation*, Notice of Motion, Civil Action No. 00 Civ. 3300 (JHL), dated Feb. 22, 2001.
*RTC Industries, Inc.* v. *William Merit & Associates, Inc.*, Evidentiary Objections to RTC Industries, Inc.'s Memorandum in Opposition to William Merit & Associates' Motion for Partial Summary Judgment, Civil Action No. 04 C 1254, dated Jul. 2, 2004.
*RTC Industries, Inc.*, v. *William Merit & Associates, Inc.*, William Merit & Associates' Reply to RTC Industries, Inc.'s Response to William Merit & Associates' Statement under Local Rule 56.1 of Material Facts to Which There is No Genuine Issue and Statement of Additional Facts that Require the Denial of Summary Judgment, Civil Action No. 04 C 1254, dated Jul. 2, 2004.
*RTC Industries, Inc.* v. *William Merit & Associates, Inc.*, Exhibits and Declarations in Support of William Merit & Associates, Inc.'s Reply to RTC Industries, Inc.'s Memorandum in Opposition to William Merit & Associates' Motion for Partial Summary Judgment, Civil Action No. 04 C 1254, dated Jul. 2, 2004.
*RTC Industries, Inc.*, v. *William Merit & Associates, Inc.*, Notice of RTC Industries, Inc.'s Motion for Leave to File its Sur-Reply to William Merit's Motion for Partial Summary Judgment, Civil Action No. 04 C 1254, dated Jul. 6, 2004.
*RTC Industries, Inc.*, v. *William Merit & Associates, Inc.*, RTC Industries, Inc.'s Sur-Reply to William Merit's Motion for Partial Summary Judgment, Civil Action No. 04 C 1254, dated Jul. 6, 2004.
*RTC Industries, Inc.* v. *William Merit & Associates, Inc.* RTC's Response to Defendant's Evidentiary Objections to RTC Industries, Inc.'s Memorandum in Opposition to William Merit & Associates' Motion for Partial Summary Judgment, Civil Action No. 04 C 1254, dated Jul. 6, 2004.
*RTC Industries, Inc.* v. *Fasteners for Retail Inc.*, Plaintiff RTC Industries Inc.'s Complaint, Civil Action No. 03C 3137, dated May 12, 2003.
*RTC Industries, Inc.*, v. *Fasteners for Retail Inc.*, and CVS Corporation, Amended Complaint, Civil Action No. 03C 3137, dated Aug. 6, 2003.
*RTC Industries, Inc.* v. *Semasys, Inc., and Uni-Sun, Inc.*, Complaint, Civil Action No. 04C 4081, dated Jun. 17, 2004.
*RTC Industries, Inc.* v. *Display Specialties, Inc.*, Complaint, Civil Action No. 04C 3370, dated May 12, 2004.
*RTC Industries, Inc.* v. *William Merit & Associates, Inc.*, Complaint, Civil Action No. 04C 1254, dated Feb. 18, 2004.
*RTC Industries, Inc.* v. *William Merit & Associates, Inc.*, Defendant's Notice of Motion for Partial Summary Judgment of Non-Infringement that Claims 1-8 of U.S. Patent No. 4,830,201 are Not Infringed, Civil Action No. 04C 1254, dated Apr. 29, 2004.
*RTC Industries, Inc.*, v. *William Merit & Associates, William Merit &* Associates, Inc.'s Statement Under Local Rule 56.1 of Material Facts to Which There is no Genuine Issue, Civil Action No. 04 C 1254, dated Apr. 29, 2004.
*RTC Industries, Inc.* v. *William Merit & Associates, Inc.*, Defendant's Notice of Motion for Leave to File Memorandum in Support of Motion for Partial Summary Judgment in Excess of Page Limit, Civil Action No. 04 C 1254, dated Apr. 29, 2004.
*RTC Industries, Inc.* v. *William Merit & Associates, Inc.*, Declaration of William Merit in Support of Defendant's Motion for Partial Summary Judgment that Claims 1-8 of U.S. Patent No. 4,830,201 are Not Infringed, Civil Action No. 04 C 1254, dated Apr. 29, 2004.
*RTC Industries, Inc.* v. *William Merit & Associates, Inc.*, RTC Industries, Inc.'s Responses to Defendant William Merit & Associates, Inc.'s First Set of Requests for Admission to Plaintiff RTC Industries, Inc., Civil Action No. 04 C 1254, dated Jun. 1, 2004.
*RTC Industries, Inc.*, v. *William Merit & Associates, Inc.*, RTC Industries, Inc.'s Memorandum in Opposition to William Merit & Associates' Motion for Partial Summary Judgment, Civil Action No. 04 C 1254, dated Jun. 18, 2004.
*RTC Industries, Inc.* v. *William Merit & Associates, Inc.*, Notice of Filing of Additional Exhibit (the Chesley Patent) to RTC Industries, Inc.'s Memorandum in Opposition to William Merit & Associates' Motion for Partial Summary Judgment, Civil Action No. 04 C 1254, dated Jun. 22, 2004.
*RTC Industries, Inc.* v. *William Merit & Associates, Inc.*, William Merit & Associates Inc.'s Reply to RTC Industries, Inc.'s Memorandum in Opposition to William Merit & Associates' Motion for Partial Summary Judgment, dated Jul. 2, 2004.
*RTC Industries, Inc.*, v. *Fasteners for Retail, Inc. And SuperValu, Inc. d/b/a Cub Foods*, Answer of Defendant Fasteners for Retail, Inc., Civil Action No. 05 C 6940, Document 20, filed Jan. 18, 2006.
*RTC Ind* v. *William Merit & Assoc.*, United States District Court Northern District of Illinois (Chicago), Case #:1:04-cv-01254.
*RTC Ind.* v. *Fasteners for Retail, et al.*, United States District Court Northern District of Illinois (Chicago), Case #:1:03-cv-03137.
*RTC Ind.* v. *HMG Worldwide Corp.*, United States District Court Northern District of Illinois (Chicago), Case #:1:00-cv-03300.
*RTC Ind.* v. *Display Specialties*, United States District Court Northern District of Illinois (Chicago), Case #:1:04-cv-03370.
*RTC Ind.* v. *Semasys Inc., et al.* United States District Court Northern District of Illinois (Chicago), Case #:1:04-cv-04081.
*RTC Ind.* v. *Fasteners for Retail, et al.*, United States District Court Northern District of Illinois (Chicago), Case #:1:05-cv-06940.
*VIDPRO International Inc.* v. *RTC Industries, Inc.*, U.S. District Court Northern District of Texas (Dallas), Case #:3:95-cv-01055-G.
*RTC Industries, Inc.* v. *Fasteners for Retail Inc., and CVS Corporation*, Reply, Civil Action No. 03C 3137, dated Sep. 17, 2003.
*RTC Industries, Inc.* v. *Fasteners for Retail, Inc. and CVS Pharmacy, Inc.*, to Vulcan Spring & Mfg. Co., Subpoena in a Civil Case, Case No. 03C 3137 N.D. Illinois, dated Oct. 28, 2003.
*RTC Industries, Inc.* v. *Fasteners for Retail Inc., and CVS Pharmacy, Inc.*, to Rexam Beauty and Closures, Inc., Subpoena in a Civil Case, Case No. 03C 3137 N.D. Illinois, dated Nov. 11, 2003.
*RTC Industries, Inc.* v. *Fasteners for Retail Inc., and CVS Pharmacy, Inc.*, to Rexam Cosmetic Packaging, Inc., Subpoena in a Civil Case, Case No. 03C 3137 N.D. Illinois, dated Nov. 11, 2003.
*RTC Industries, Inc.* v. *Fasteners for Retail Inc., and CVS Pharmacy, Inc.*, to Rexam Cosmetic Packaging, Inc., Subpoena in a Civil Case No. 03C 3137 N.D. Illinois, dated Nov. 11, 2003.
*RTC Industries, Inc.* v. *Fasteners for Retail Inc., and CVS Pharmacy, Inc.*, to Rexam Beauty and Closures, Inc., Subpoena in a Civil Case, Case No. 03C 3137 N.D. Illinois, dated Nov. 11, 2003.
*RTC Industries, Inc.* v. *Fasteners for Retail Inc., and CVS Corporation*, Notice of Motion to Modify and Temporarily Quash Five Subpoenas for Violation of Federal Rule of Civil Procedure 45, Civil Action No. 03C 3137, dated Dec. 8, 2003.
*RTC Industries, Inc.* v. *Fasteners for Retail, Inc. and CVS Pharmacy, Inc.*, Defendants' Opposition to Plaintiffs Motion to Modify and Temporarily Quash Five Subpoenas for Violation of Federal Rule of Civil Procedure 45, Case No. 03C 3137, dated Dec. 10, 2003.
*RTC Industries, Inc.* v. *Fasteners for Retail Inc., and CVS Corporation*, RTC Industries' Reply to Defendants' Opposition to RTC's Motion to Modify and Temporarily Quash Five Subpoenas for Violation of Federal Rule of Civil Procedure 45, Civil Action No. 03C 3137, dated Dec. 11, 2003.
*RTC Ind. Inc.* v. *Fasteners for Retail*, Minute Order of Dec. 12, 2003 by Honorable Joan B. Gottschall, Case No. 1:03-cv-03137.
*RTC Industries, Inc.*, v. *William Merit & Associates, Inc.*, RTC Industries, Inc.'s Response to William Merit & Associates Statement under Local Rule 56.1 of Material Facts to Which There is no Genuine Issue and Statement of Additional Facts that Require the Denial of Summary Judgment, Civil Action No. 04 C 1254, dated Jun. 18, 2004.
*RTC Industries, Inc.,* v. *William Merit & Associates, Inc.,* Index of Exhibits, Civil Action No. 04 C 1254, dated Jun. 18, 2004.
*RTC Industries, Inc.*, v. *Henschel-Steinau, Inc*., Complaint, Case: 1:10-cv-07460 Document #:1 Filed Nov. 19, 2010.

* cited by examiner

PRODUCT MANAGEMENT DISPLAY SYSTEM

CROSS REFERENCE TO RELATED APPLICATIONS

This application is a continuation of U.S. application Ser. No. 11/216,493, filed Aug. 31, 2005, issued as U.S. Pat. No. 7,093,546, which is a continuation of U.S. application Ser. No. 10/474,490, filed Oct. 8, 2003, issued as U.S. Pat. No. 6,964,235, which claims priority to U.S. Provisional Application Ser. No. 60/291,732, filed May 17, 2001, and PCT Application Serial Number PCT/US02/15760, filed May 17, 2002.

FIELD OF THE INVENTION

The invention relates to a system for displaying, pushing, and dividing merchandise on merchandise-display shelves.

BACKGROUND OF THE INVENTION

It is desirable to have merchandise on a shelf situated toward the front of the shelf so that the merchandise is visible and accessible to shoppers. Thus, as merchandise is removed from a shelf, it may be advantageous to push the remaining merchandise toward the front of the shelf. It may also be desirable to include dividing panels, also referred to as dividers, to separate merchandise into rows on a display shelf.

Commonly assigned U.S. Pat. No. 6,041,720 ("the '720 patent") discloses a product management display system that may be used for dividing and pushing displayed merchandise.

DE 299-02,688 U1 discloses a merchandise display system in which a base-and-divider assembly is constructed as two separate units that need to be connected to each other before being used. When this system is used with products having different sizes, product slider guides, also referred to herein as pusher tracks, of various widths need to be used to accommodate the different sizes of the products.

U.S. Pat. No. 5,265,738 discloses a merchandise display system with a pusher track that has an integrated divider wall on one side of the pusher track. Like the system disclosed by DE 299-02,688 U1, pusher tracks having different widths must be used to accommodate products of different sizes.

Referring to FIG. 1 of the '720 patent, various components, such as pusher end device 150, pusher divider 152, and pusher 154 mounted on bases 166, 212, and 232, respectively, are disclosed for mounting onto either shelf frame 25 or standard dealer shelf 40. The pusher end device 150, the pusher divider 152, and the pusher 154, which are mounted to bases 166, 212, and 232, of FIG. 1 of the '720 patent were designed with ultimate flexibility in mind. This flexibility allows these components to be assembled and used in many different ways depending on the particular product to be displayed. This presents store personnel with potentially confusing choices, which may lead to frustration, wasted time, and incorrectly installed parts. Three pusher components, namely, a full-width track, which can accept the pushing device, a divider, and a narrow track, are typically used together more often than other combinations of components. Therefore, a component that combines these devices into a single integrated assembly would be desirable.

SUMMARY OF THE INVENTION

An integrated "T" assembly, also referred to as a base-and-divider assembly, in accordance with an illustrative embodiment of the invention combines into a single integrated assembly, a full-width track, a divider, and a narrow track. A narrow and strong end-finisher piece may be used to provide a second divider-like partition and, optionally a wide or narrow track, for pairing with a T assembly's narrow-track or wide-track portion near an end of either side of a shelf.

In accordance with an illustrative embodiment of the invention, a spring-urged offset pusher may have an upper portion that is offset, via an angled offset portion, from a lower portion of the pusher. The upper offset portion may advantageously extend farther out toward the center of various products to be displayed. Such an offset pusher may allow for using a minimal number of components while still pushing products relatively near to their centers, having the advantage of pushing them smoothly with less binding. When displaying a wide product, one or more supporting tracks, any of which may have a pusher, may be used under the product.

In accordance with an illustrative embodiment of the invention, a T assembly and/or a full track may be coupled to a front rail via a complimentary tongue and groove arrangement. Any of the components having a divider panel, such as a T assembly, an end finisher, and a full-width track, may also contain any of various engagement mechanisms for non-slidably engaging with a front rail's corresponding engagement mechanism. For instance, teeth on a base may engage corresponding teeth on the front rail. Teeth of this type advantageously allow a T assembly, full-width track, and/or end finishers with corresponding teeth to be located at positions virtually continuously along the front rail and may prevent the components from being moved unintentionally from their intended positions during normal shopping activity and shelf re-stocking.

In accordance with an illustrative embodiment of the invention, a T assembly may include a tear-off line and a break-off line. Such a tear-off line and break-off line combination may be used to advantage to produce one part that may be used for shelves having different depths, such as either 16 inches or 10 inches.

In accordance with an illustrative embodiment of the invention, a pusher track may include a depression, which may be used while re-stocking merchandise to hold a pusher near the back of a full-width track or T assembly. To use the depression to hold a pusher at the back of the track, a person may move the pusher back to the depression and may tilt the top of the pusher toward the front of the track. Merchandise may be re-stocked without having to manually hold the pusher out of the way. To remove the pusher from the depression, the pusher may be pushed toward the back of the track, the pusher will then return to an upright position and move along the track in its usual way.

In accordance with an illustrative embodiment of the invention, front edges of the respective surfaces that the pusher travels along may automatically engage a bent portion of the pusher's coiled spring when the pusher is inserted onto the front of the track.

Additional features and advantages of the invention will be apparent upon reviewing the following detailed description.

DETAILED DESCRIPTION OF THE INVENTION

Figure 1:
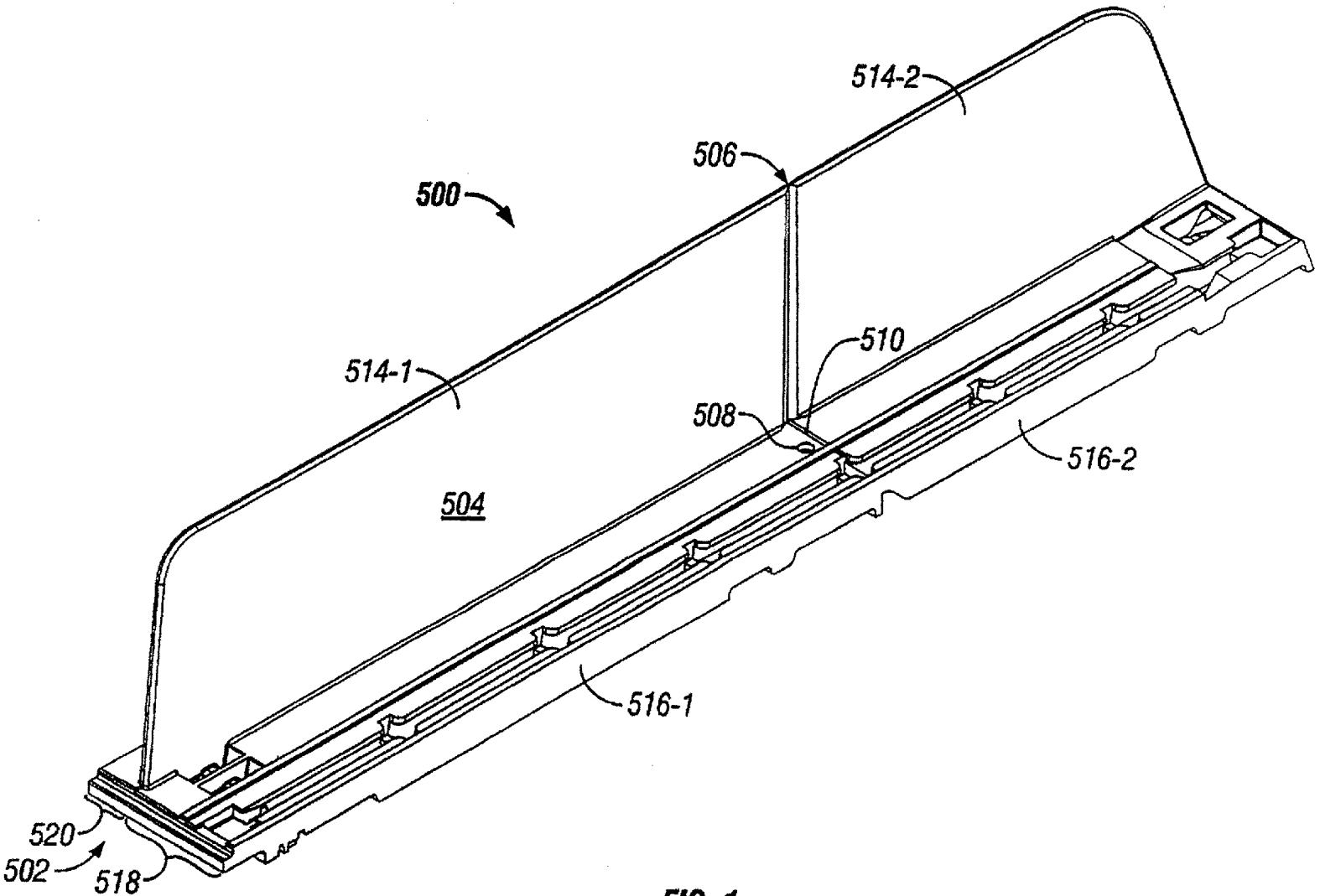
FIG. 1 depicts an integrated "T" assembly, also referred to as a base-and-divider assembly, in accordance with an illustrative embodiment of the invention.
Figure 5:
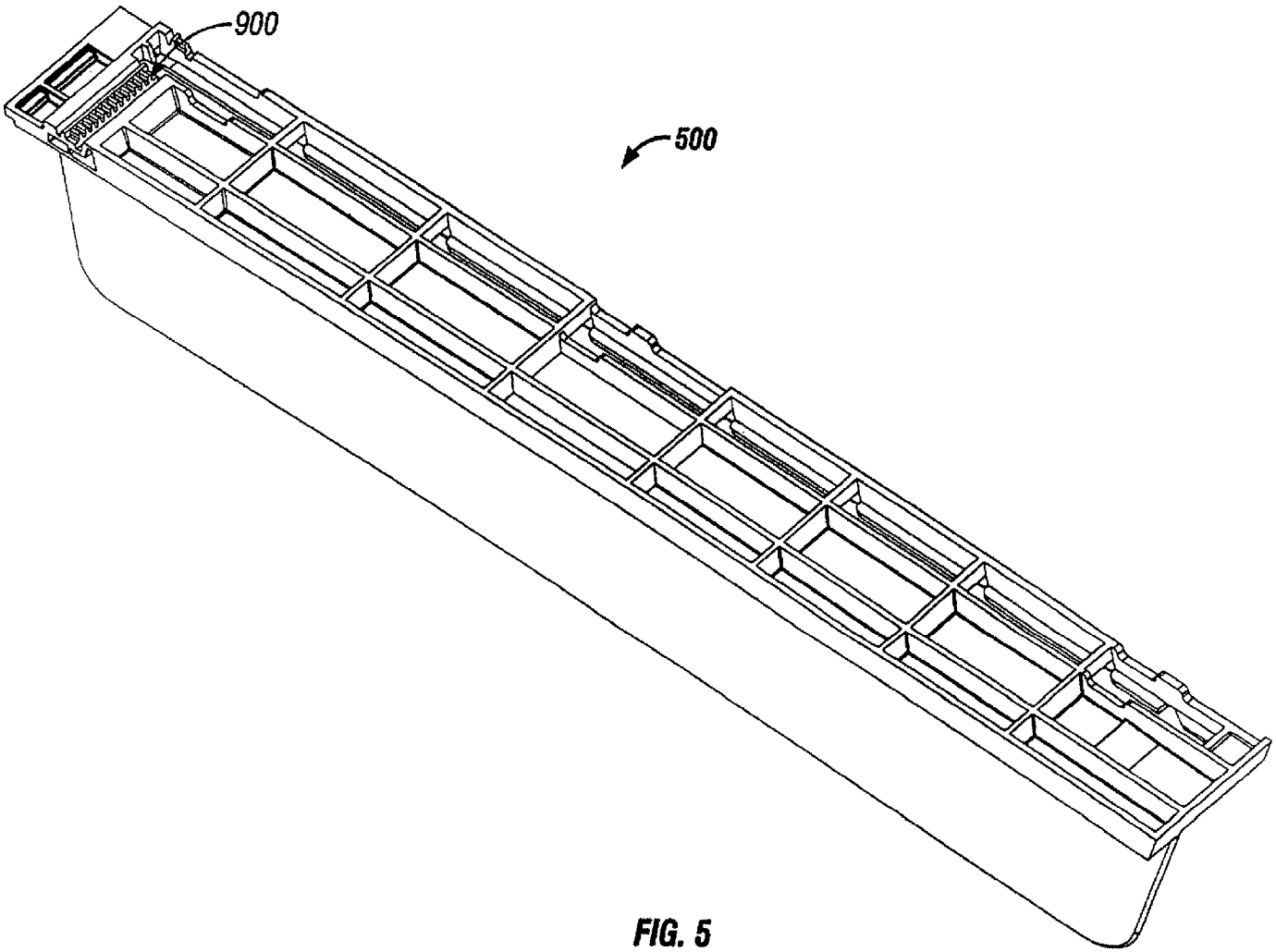
FIG. 5 is perspective view of the bottom of a T assembly in accordance with an illustrative embodiment of the invention.

FIG. 1 depicts an integrated "T" assembly 500 in accordance with an illustrative embodiment of the invention. The "T" refers to the appearance of the T assembly 500 as viewed in the direction of arrow 502 in FIG. 5. T assembly 500 would actually look like an upside-down (and off-center) T, but for the sake of brevity, it is referred to simply as a T assembly. The T assembly may also be referred to as a base-and-divider assembly. The T assembly essentially combines into a single assembly, a first track, a divider, and a second track. In accordance with an illustrative embodiment of the invention, the divider portion 504, the first portion 518 of the base, and the second portion of the base 520 may be manufactured as a single integrated component.

In accordance with an illustrative embodiment of the invention shown in FIG. 1, a divider 504 may divide the base of the T assembly 500 into a first portion 518 and a second portion 520. The first portion 518 of the base may be referred to as a wide portion of the base and the second portion 520 may be referred to as a narrow portion 520 of the base 500. As will be apparent any suitable ratio of widths may be chosen for the first and second portions of the base. For instance, the divider 504 may bisect the base such that the base's first and second portions are of a substantially equal width.

T assembly 500 may have a relatively thick and rigid divider 504 to prevent deflection that might occur when pushing round or triangular objects. Deflection of this type could cause those objects to slip by one another or not to push well in general. In FIG. 1, rigid divider 504 includes two parts, 514-1 and 514-2, which are described below.

Figure 2:
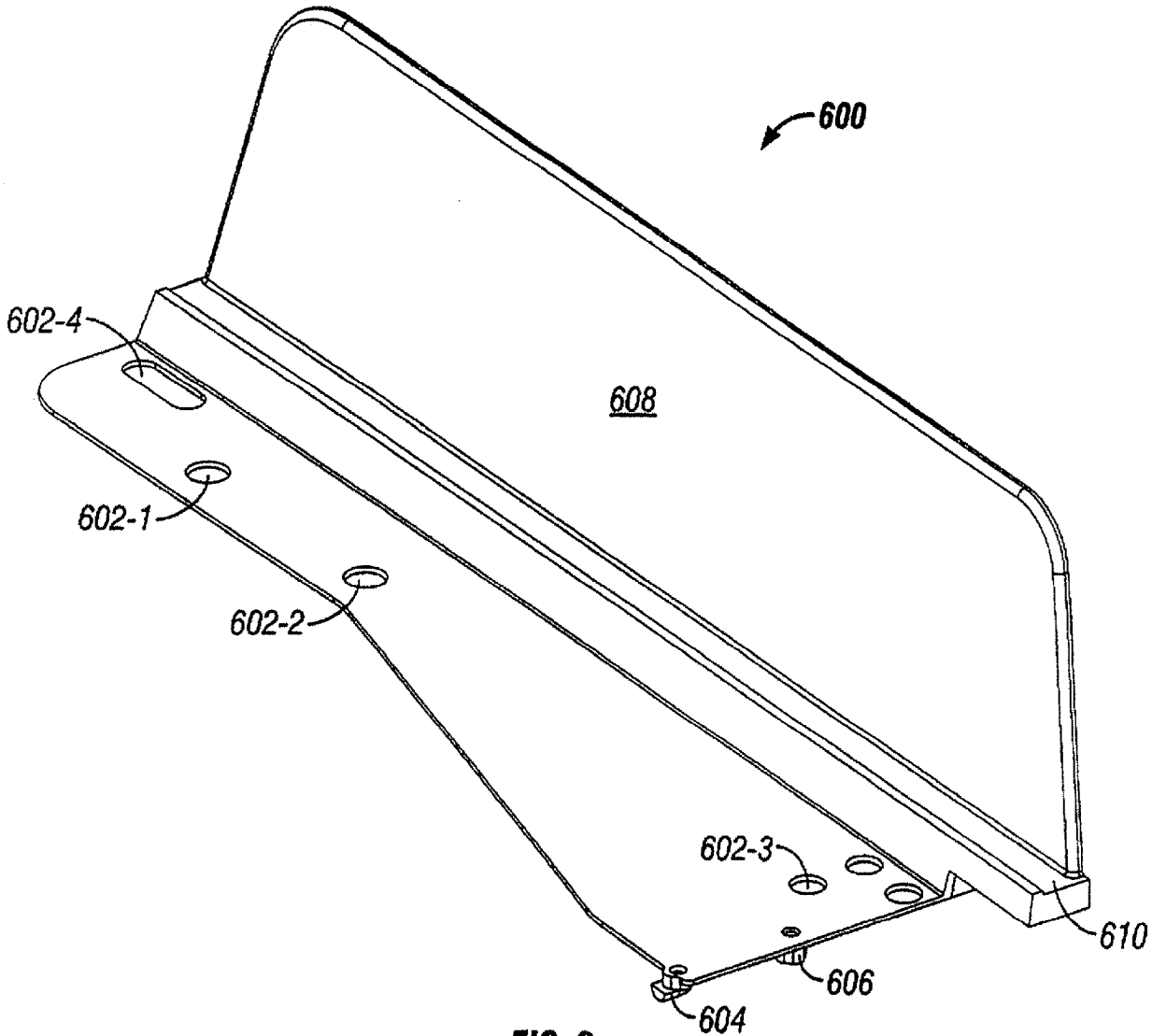
FIG. 2 depicts a right end component in accordance with an illustrative embodiment of the invention.

At either end of a shelf using the pusher components, a narrow and strong end-finisher component is desirable. Referring to FIG. 2, a right-end component 600 may be fastened to a shelf near the right-hand side of the shelf. The right-end component's divider 608 may act the right-most divider on the shelf. The right-end component 600 may be operatively coupled to a shelf by inserting pegs 604 and 606 through corresponding holes in a shelf. One or more fasteners, such as plastic push-rivets, may be used through holes 602-1 through 602-4, and corresponding holes in a shelf, to securely fasten the right-end component to the shelf.

Figure 11:
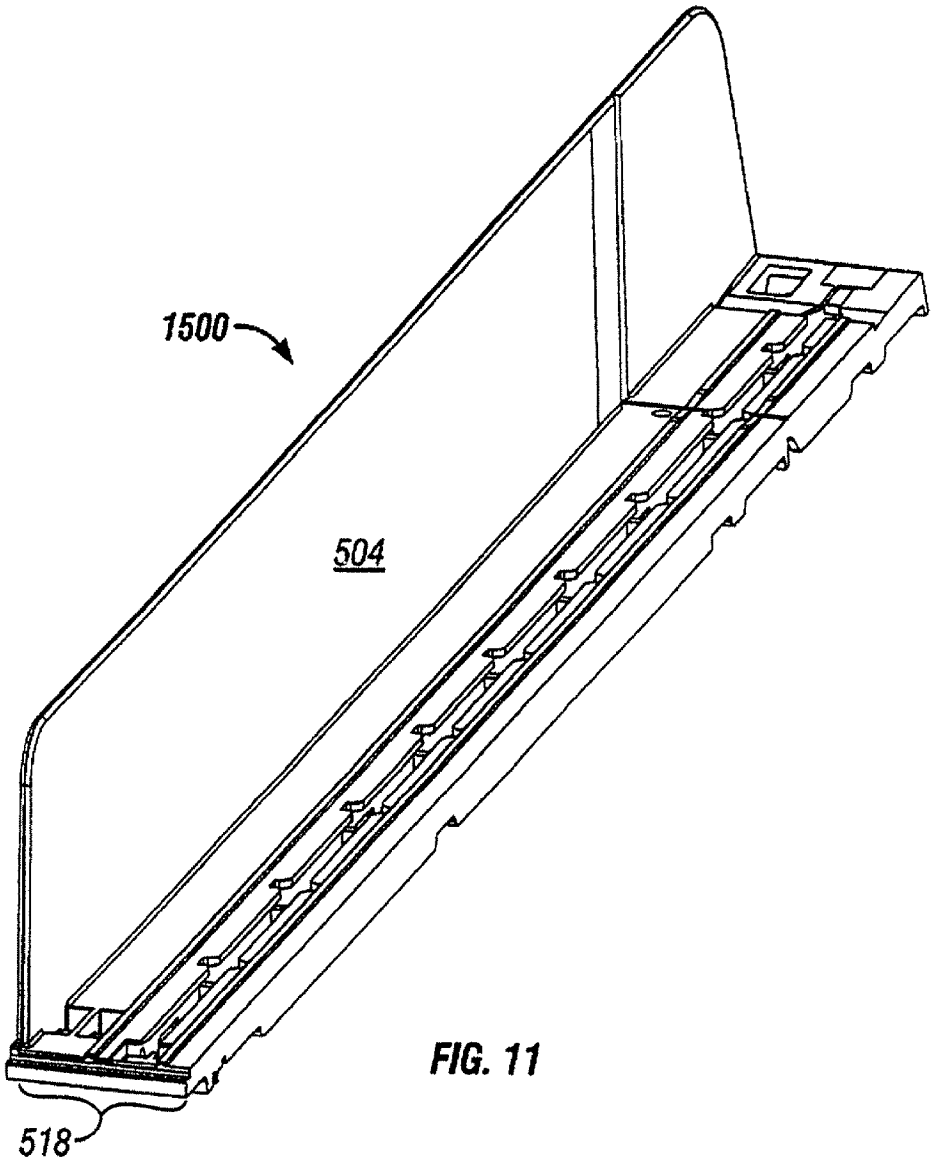
FIG. 11 depicts an integrated end component in accordance with an illustrative embodiment of the invention.

The right-end component shown in FIG. 2 is intended to be placed at a fixed location near the right side of a shelf's top surface. Referring to FIG. 11, a left-end component 1500 may be similar to a T assembly 500 except that, for the left-end component 1500 the portion of the T assembly's base to the left of the divider is omitted. Accordingly, the left-end component 15 may include a divider 504 and a base portion 518. Because the right-end component is intended to have a fixed location and the other components may have adjustable positions along a rail near the front of a shelf, components may be placed onto the shelf and the front rail from right to left to allow for maximum flexibility in adjusting the distances between the components.

Figure 3:
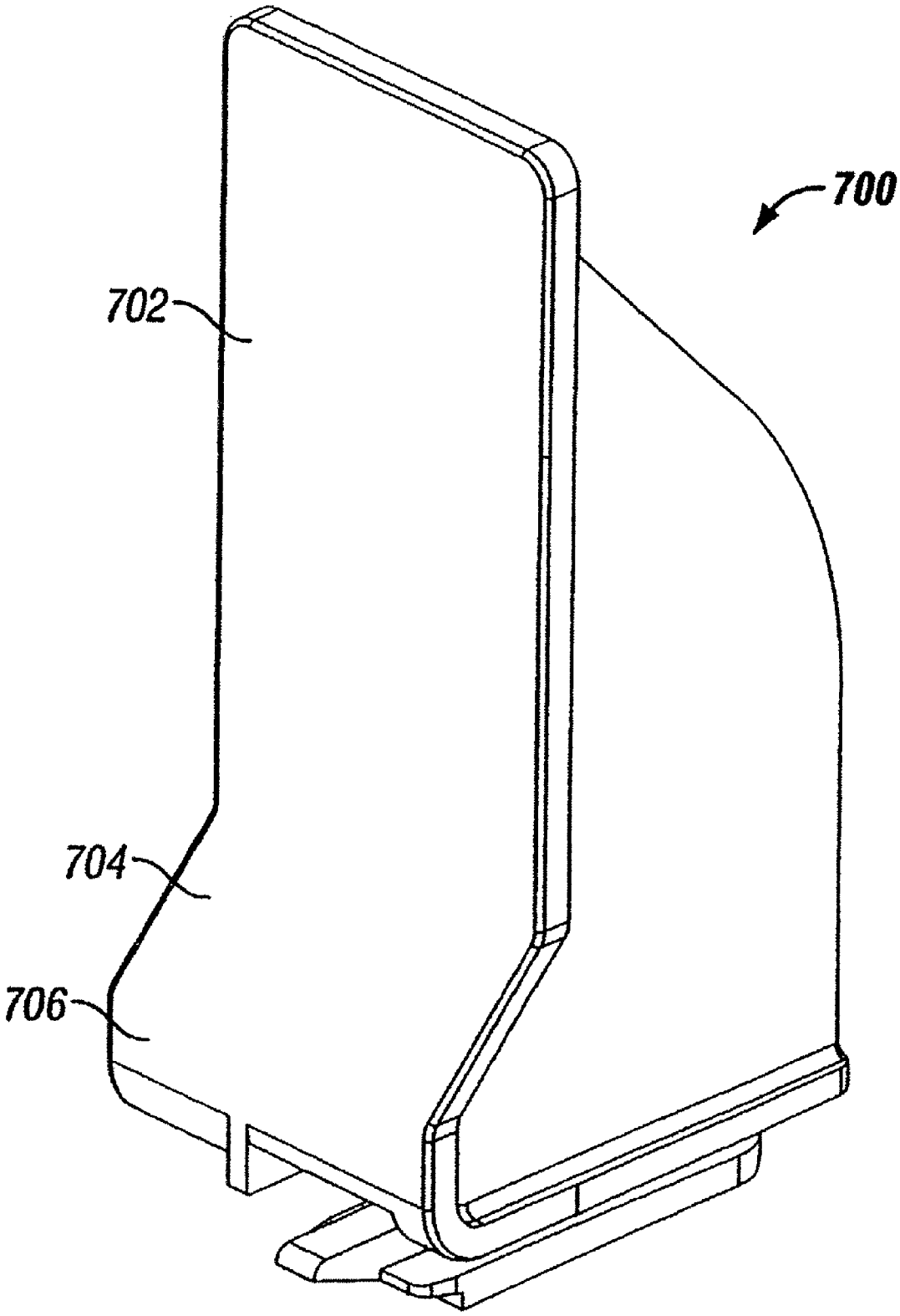
FIG. 3 shows an offset pusher in accordance with an illustrative embodiment of the invention.
Figure 10:
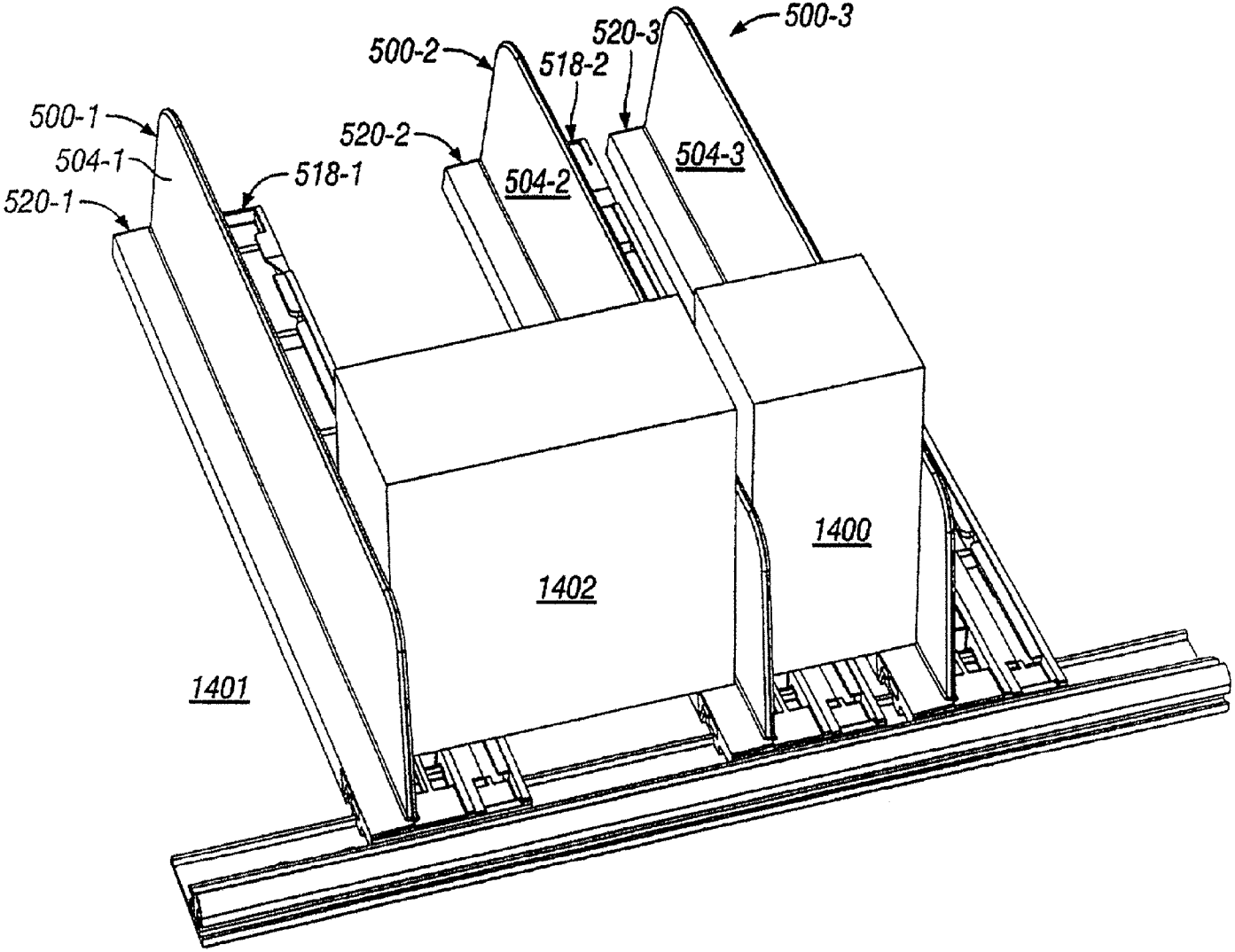
FIG. 10 depicts products of different sizes on multiple T assemblies.

The width of many products, such as deodorants, analgesics, antihistamines, would allow a minimum number of pusher and base components to be used, spaced laterally apart from each other along a shelf, but the pushers may undesirably end up sufficiently off-center such that the products do not get pushed well. For instance, referring to FIG. 10, multiple T assemblies 500-1 through 500-3 are shown operatively coupled to a shelf 1401 via a front rail. A relatively narrow product 1400 is shown being supported by the wide portion 518-2 of the base of T assembly 500-2 and by the narrow portion 520-3 of the T assembly 500-3. T assemblies 500-2 and 500-3 are positioned relatively close to each other because product 1400 is relatively narrow. Product 1402, however, is relatively wide. T assembly 500-1, therefore, is spaced relatively far away from T assembly 500-2. The product 1402 is supported by the narrow portion 520-2 of the base of the T assembly 500-2 and the wide portion 518-1 of the base of the T assembly 500-1. Because the pusher track and pusher of the T assembly 500-1 are located relatively close to the divider 504-1 of T assembly 500-1, an offset pusher, such as the offset pusher 700 (FIG. 3) may be used so that the offset portion 702 may be positioned closer to the center of a relatively wide product, such as product 1402. Offset pusher 700 has an upper portion 702 that is offset, via an offset portion 704, from a lower portion 706 of the pusher 700. Upper offset portion 702 advantageously extends farther out toward the center of various products to be displayed. The offset pusher allows for using a minimal number of components while still pushing products relatively near to their centers.

Occasionally a product is too wide to use only T assemblies 500 on either side of the product. Under these circumstances, one or more supporting tracks may be used under the product. In addition, a product may be unusually dense and/or heavy such that the product requires another track with an additional pusher to move the product. Under these circumstances, a full-width track, such as full-width track 800, shown in FIG. 4 and also referred to as a base, may be used either with or without a pusher 700.

Figure 8:
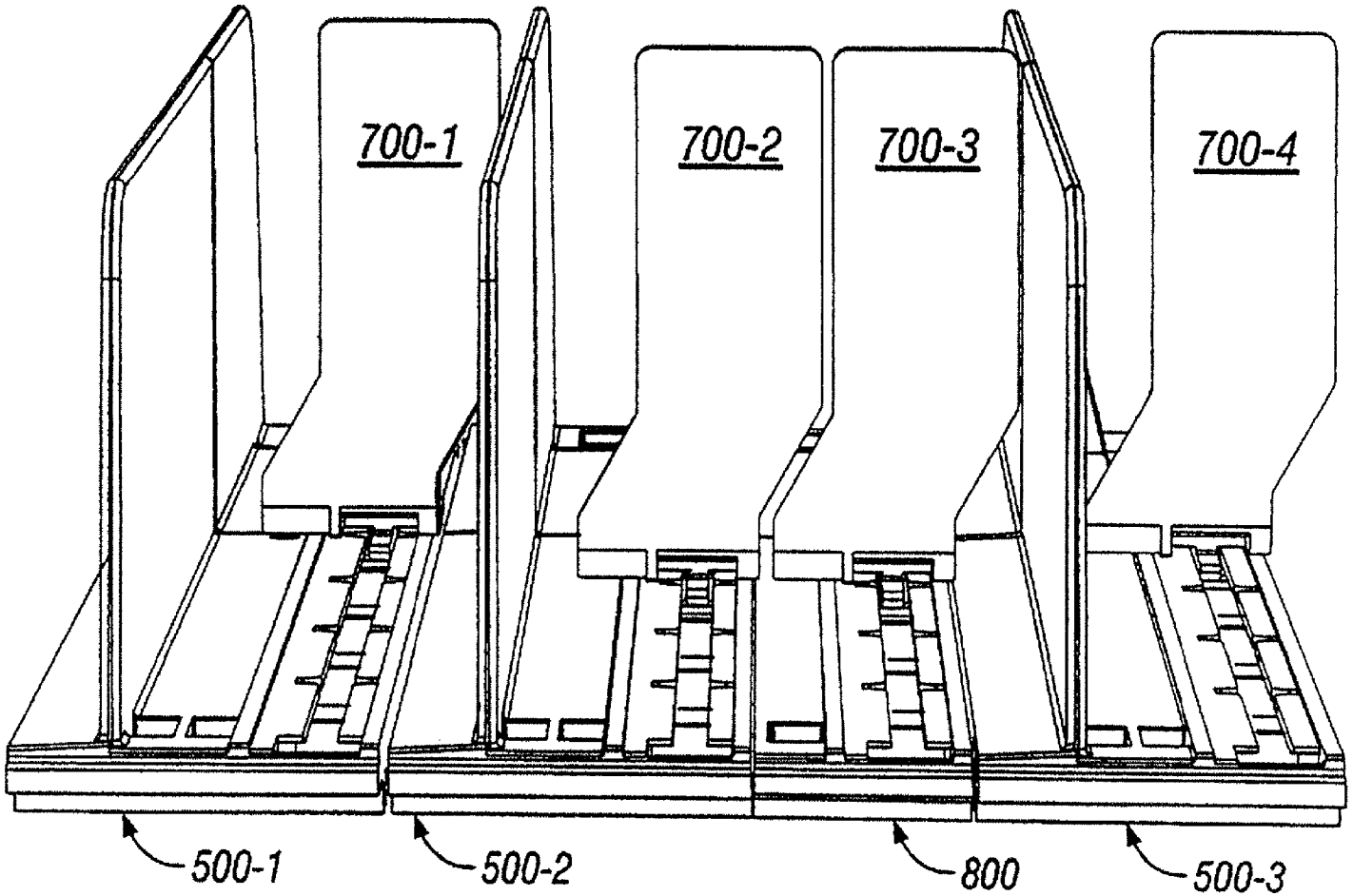
FIG. 8 depicts a full-width track with a pusher between two T assemblies in accordance with an illustrative embodiment of the invention.

For instance, FIG. 8 depicts a full-width track 800 with a pusher 700-3 between two T assemblies 500-2 and 500-3 with pushers 700-2 and 700-4 to the left and right sides, respectively, of the full-width track 800.

Figure 6:
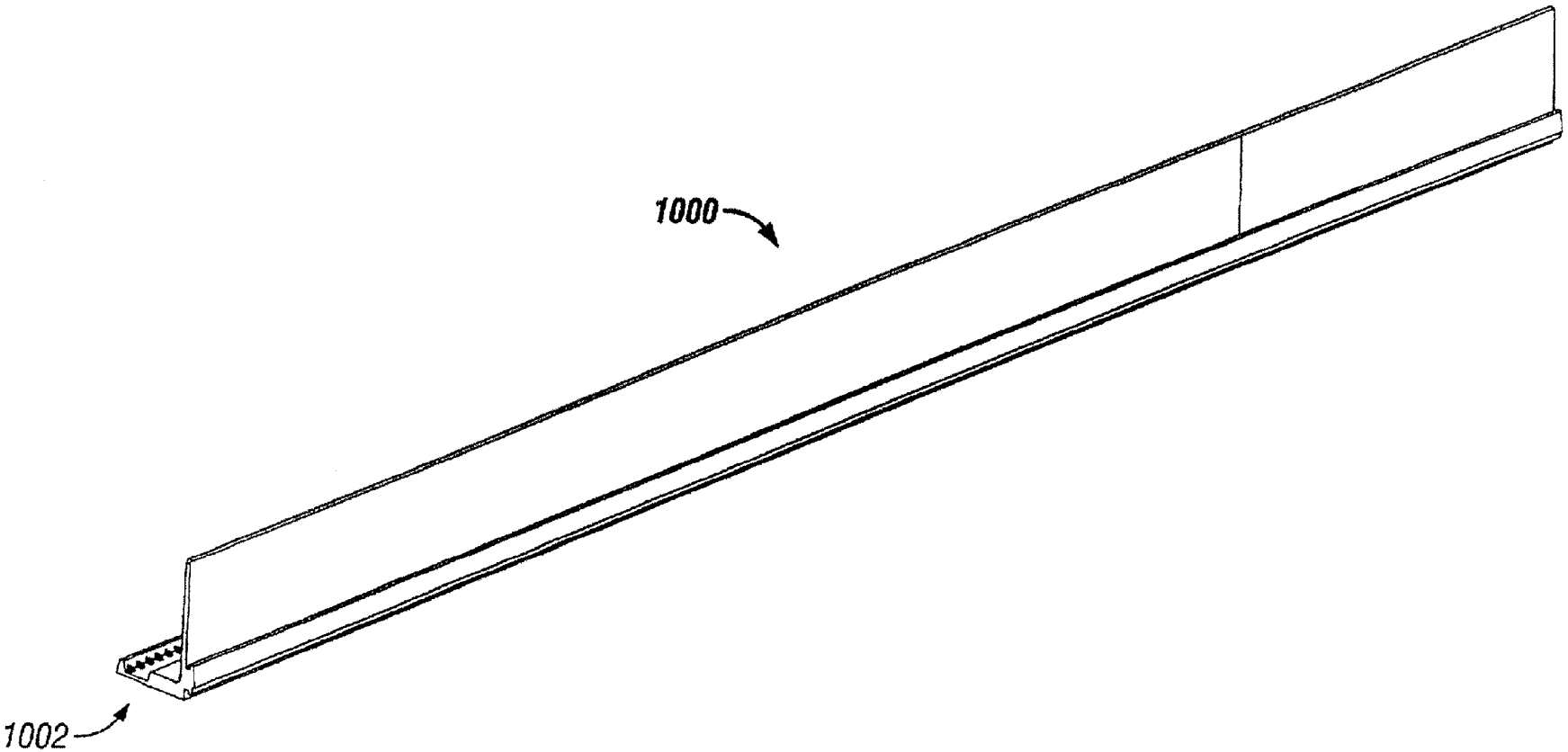
FIG. 6 is a perspective view of a front rail in accordance with an illustrative embodiment of the invention.
Figure 7:
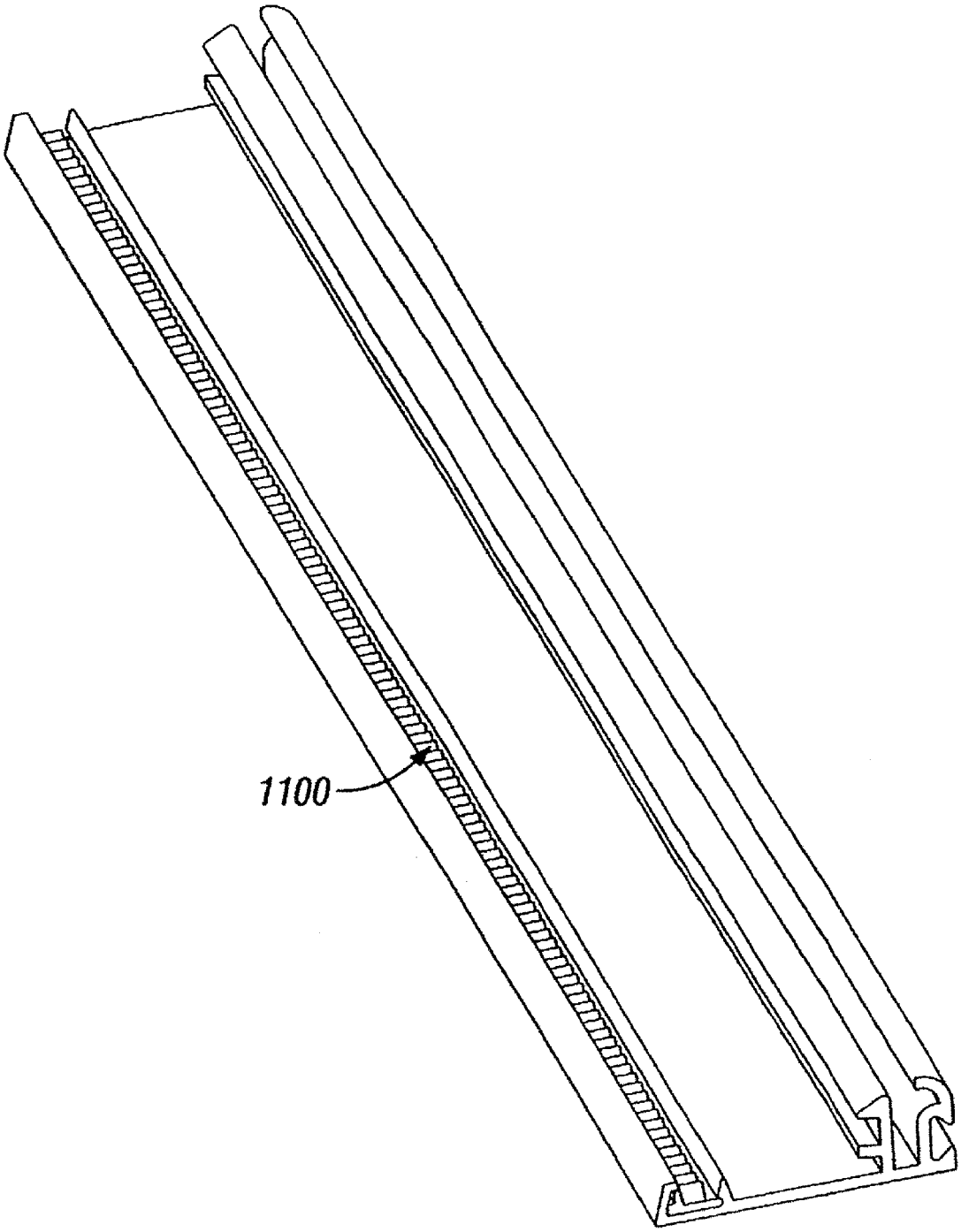
FIG. 7 is an enlarged oblique side view of the front rail of FIG. 7 in accordance with an illustrative embodiment of the invention.

In accordance with an illustrative embodiment of the invention, any of the components, which have a divider and/or a pusher track, may be coupled to a front rail via a complimentary tongue and groove arrangement as disclosed in the '720 patent. The T assembly 500 and full track 800 may non-slidably engage each other. For instance, teeth 900, shown in FIG. 5, may engage a corresponding non-slidable engagement detail in a front rail, such as front rail 1000 shown in FIG. 6. FIG. 7 is an enlarged oblique side view of the front rail 1000, viewed from the direction indicated by arrow 1002 in FIG. 6. Teeth 1100 allow a T assembly 500, full-width track 800, and/or a left-end component with corresponding teeth to be located at virtually continuous positions along the front rail. The mating teeth may be relatively thin and closely spaced to allow for precise placement of pusher-track components. The teeth advantageously prevent the components from being unintentionally moved from their intended positions during normal shopping activity and shelf re-stocking.

As will be apparent, other ways of positively engaging T assembly 500, full-width track 800, and/or a left-end component with the front rail may also be used. For instance, serrations on the front rail could bite into the bottom of the pusher-track components. A compression fit arrangement could be used in which a tongue of the pusher-track component snaps into the front rail. The front rail could have rubber in a groove that would receive a serrated tongue of a pusher-track component.

Referring again to FIG. 1, the T assembly 500 may optionally include a tear-off line, such as tear-off line 506, and a break-off line, such as break-off line 510. Such a tear-off line and break-off line combination may be used to advantage to produce one part that may be used for shelves having different depths, such as either 16 inches or 10 inches. Tear-off line 506 allows tearing of the vertically oriented divider pieces 514-1 and 514-2 as a first operation. This tearing operation may then be followed by a breaking operation to separate track piece 516-1 from track piece 516-2. The combination of the tear-off line and the break-off line facilitates removal of the rear portion of the T assembly 500. As will be apparent, a full-width track and/or a right-end finisher may also optionally include a break-off line analogous to the break-off line 510.

Figure 9:
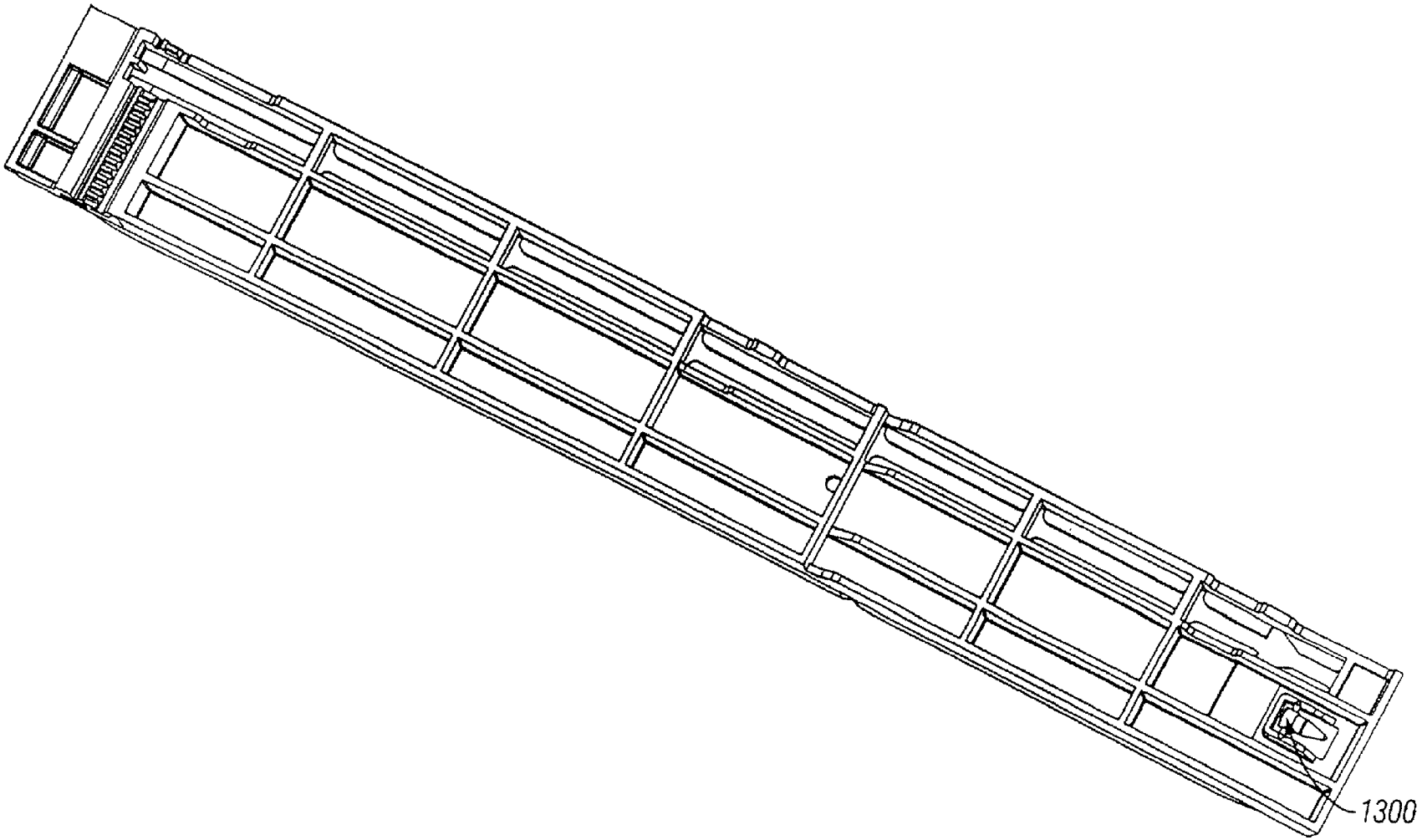
FIG. 9 is an enlarged view of the rear portion of the bottom of a T assembly in accordance with an illustrative embodiment of the invention.

After removing the rear portion of the T assembly 500 or any other base that may accept a pusher 700, the pusher 700 may be prevented from sliding out of the back of the pusher track by inserting a pin into hole 508. An exemplary pin 1300 is shown molded into the bottom rear portion of a base in FIG. 9.

Figure 4:
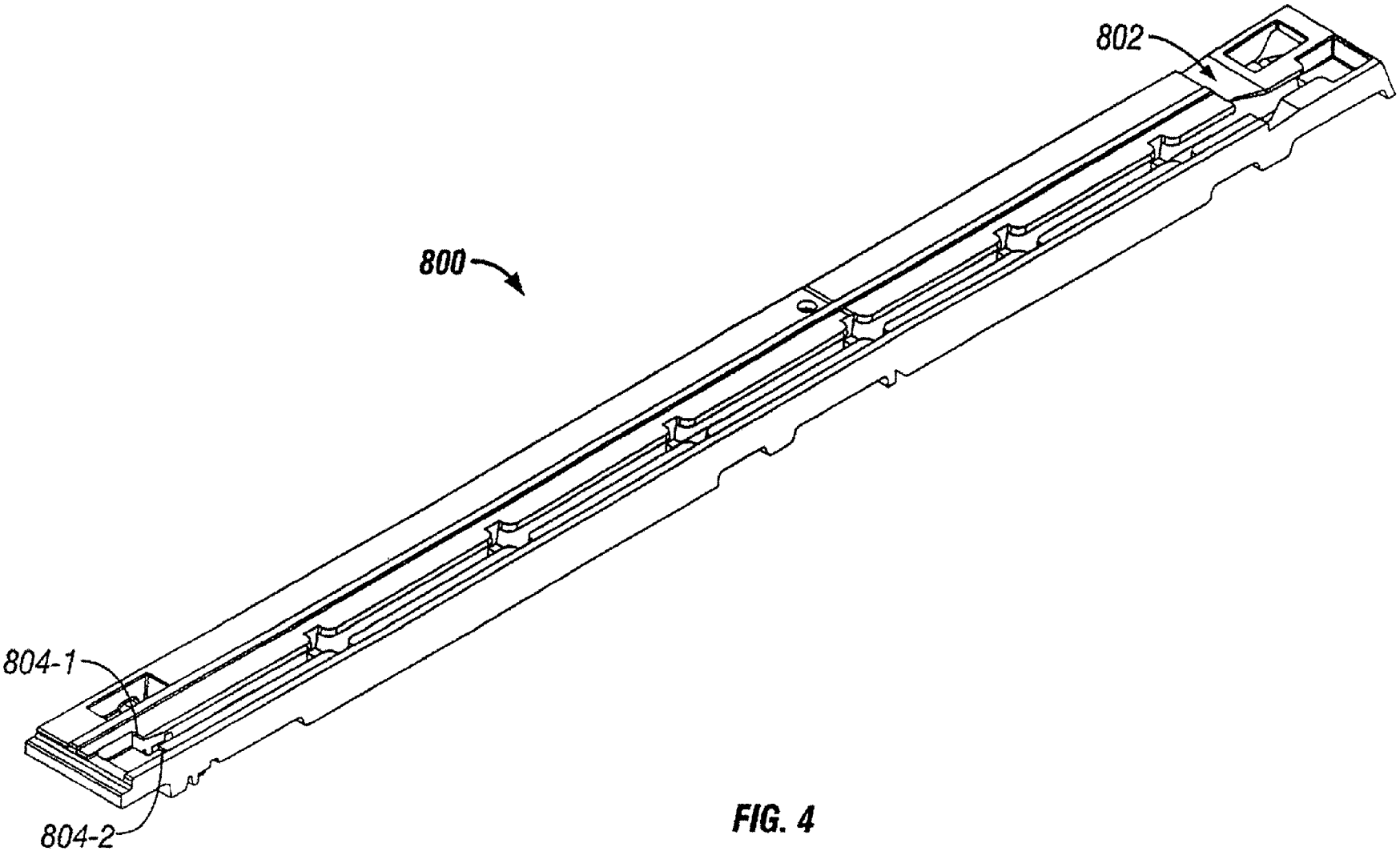
FIG. 4 shows a full-width track, also referred to as a base, which may be used with or without a pusher, in accordance with an illustrative embodiment of the invention.

Referring to FIG. 4, a depression 802 is shown. The depression 802 may be used, while re-stocking merchandise, to hold a pusher 700 near the back of a track 800 or a T assembly 500. To use the depression 802 to hold a pusher 700 at the back of the track 800, a person may move the pusher 700 back to the depression 802 and may tilt the top of the pusher 700 toward the front of the track 800, for instance, in a direction opposite of arrow 502 in FIG. 1. The depression 802 then holds the pusher 700 so that merchandise may be re-stocked without having to manually hold the pusher out of the way while placing the merchandise on the track surface. To remove the pusher 700 from the depression 802, the pusher may be pushed toward the back of the track 800, the pusher will then return to an upright position and move along the track 800 in its usual way.

Figure 12:
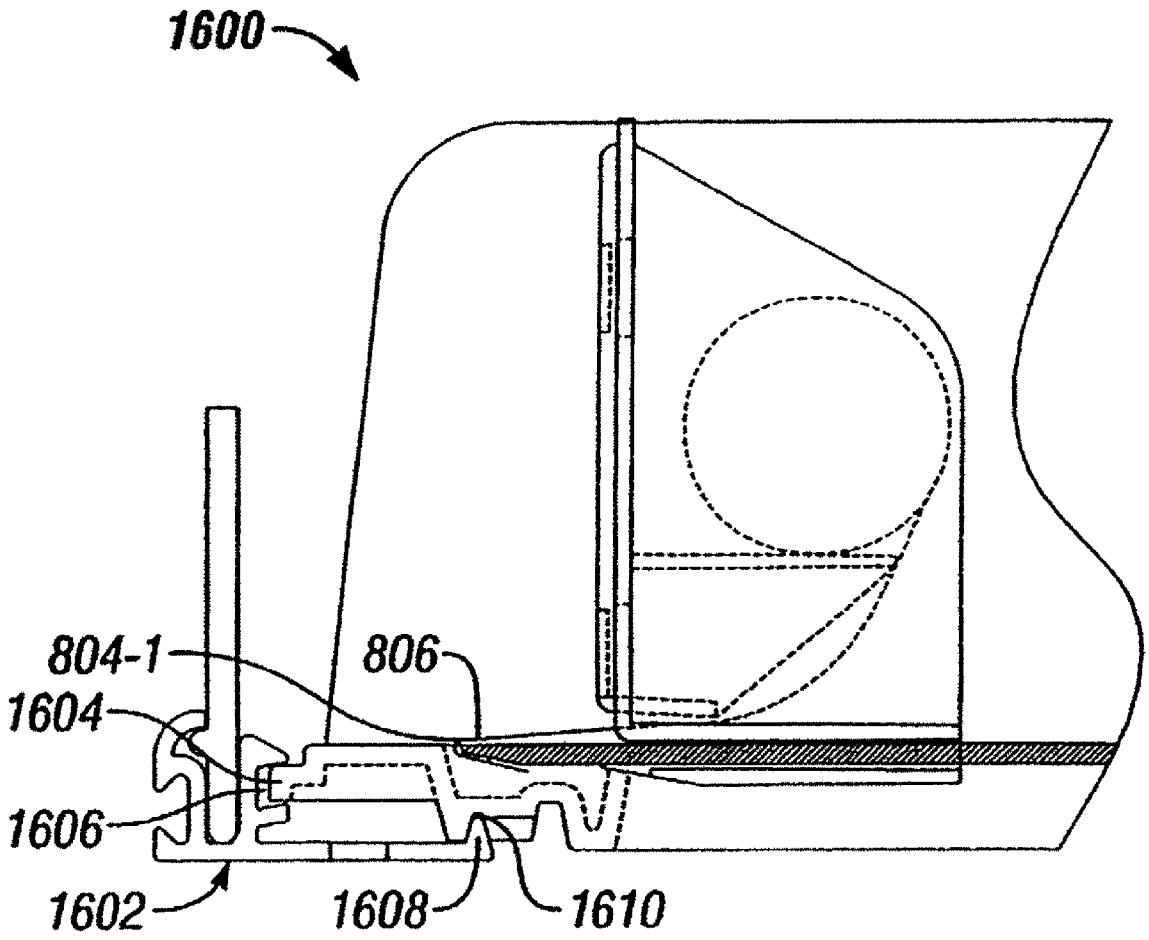
FIG. 12 is a partial side view of a cross-section of a bent end of a pusher's coiled spring engaging the front edge of a pusher track in accordance with an illustrative embodiment of the invention.

Front edges 804-1 and 804-2 of the respective surfaces that the pusher travels along may automatically engage a bent portion of the pusher's coiled spring when the pusher is inserted onto the front of the track 800. FIG. 12 is a partial side view of a cross-section of a bent end of a spring 806 engaging the front edge 804-1 of the track 800.

FIG. 12 also shows a complimentary tongue and groove engagement between a component 1600, which includes a pusher track, and a front rail 1602 in accordance with an illustrative embodiment of the invention. A tongue 1604 of the component 1600 engages a groove 1606 of the front rail 1602, and a tongue 1608 of the front rail 1602 engage a groove 1610 in the component.

While the invention has been described with respect to specific examples including presently preferred modes of carrying out the invention, those skilled in the art will appreciate that there are numerous variations and permutations of the above described systems and techniques that fall within the spirit and scope of the invention.

What is claimed is:

1. A merchandise-display system comprising:

an integrated base-and-divider assembly, wherein the base-and-divider assembly includes a base portion adapted for operative coupling to a front rail, and a divider portion for dividing displayed merchandise into rows, wherein the divider portion protrudes from the base portion such that the divider portion separates the base portion into a first portion and a second portion;

a pusher track comprising at least one rail with a top surface and a bottom surface, wherein the at least one rail defines a plurality of notches, an elongated aperture adjacent to the at least one rail, and connectors positioned beneath the notches; and a spring-urged pusher mounted to the pusher track for pushing merchandise toward the front of the shelf, the pusher comprising a pusher face having a top and a bottom, wherein the base-and-divider assembly and pusher track are separate components and each are mounted to the front rail that extends along a front portion of the shelf, wherein the pusher track includes a depression for holding the pusher near the back of the track in a shelf-stocking position, the shelf-stocking position being a position where the top of the pusher face is tilted toward the front rail.

2. The merchandise-display system of claim 1, wherein the pusher face is offset.

3. The merchandise-display system of claim 2, wherein the offset pusher face has an upper portion that is offset from a lower portion by an angled offset portion.

4. The merchandise-display system of claim 1, further comprising a coiled spring defining a first end coupled to the pusher track and a second coiled end positioned behind the pusher.

5. The merchandise-display system of claim 1, wherein the base-and-divider assembly and the pusher track are slidable relative to the front rail.

6. The merchandise-display system of claim 1, wherein the pusher engages the top and bottom surfaces of the at least one rail.

7. The merchandise-display system of claim 1, wherein the base-and-divider assembly and the pusher track are non-slidable relative to the front rail.

8. The merchandise-display system of claim 1, wherein the base portion is configured to support a first portion of a displayed product.

9. The merchandise-display system of claim 8, wherein the pusher track is configured to support a second portion of a displayed product.

10. The merchandise-display system of claim 1, further comprising:

a second integrated base-and-divider assembly defining a second base portion, and a second spring-urged pusher mounted to a second pusher track and adapted for operative coupling to the front rail.

11. The merchandise-display system of claim 10, wherein the second base portion of the second base-and-divider assembly supports a second portion of the displayed product.

12. The merchandise-display system of claim 1, further comprising:

the base portion configured to support a first portion of a displayed product;

a second integrated base-and-divider assembly defining a second base portion, wherein the second base portion of the second base-and-divider assembly supports a second portion of the displayed product; and a second spring-urged pusher mounted to a second pusher track and adapted for operative coupling to the front rail.

13. The merchandise-display system of claim 1, wherein the base portion is operatively coupled to a shelf via the front rail that is affixed to the shelf.

14. The merchandise-display system of claim 1, wherein the base portion is operatively coupled to the front rail via a tongue and groove arrangement.

15. The merchandise-display system of claim 1, wherein the pusher track is operatively coupled to the front rail via a tongue and groove arrangement.

16. The merchandise-display system of claim 1, further comprising a first rail and a second rail, the elongated aperture located between the first rail and the second rail, and wherein the first rail defines a plurality of notches and the second rail defines a plurality of notches.

17. A merchandise-display system comprising:

a unitary, one-piece base and divider assembly comprising a base and a divider, wherein the divider protrudes from the base and separates the base into a first portion and a second portion;

a front rail operatively coupled to a front portion of a shelf, the base and divider assembly mounted to the front rail;

a pusher track comprising at least one rail, an elongated aperture adjacent to the at least one rail and wherein the at least one rail defines a plurality of notches wherein connectors are positioned beneath the notches, the pusher track mounted to the front rail operatively coupled to a front portion of a shelf;

a spring-urged pusher comprising an engagement device at a bottom portion of the pusher for engaging the pusher with the pusher track, the pusher defining a pusher face having a top and a bottom; and a coil spring connected to the pusher track, wherein the base and divider assembly and pusher track are separate components, wherein the pusher track defines a depression near a rear portion of the pusher track, and wherein the depression is configured to hold the spring-urged pusher near the rear portion of the pusher track in a position where the top of the pusher face is tilted toward the front rail during restocking.

18. The merchandise-display system of claim 17 wherein the pusher track defines a front area and the coil spring defines a front portion and wherein the front end of the coil spring engages the front area of the pusher track.

19. The merchandise-display system of claim 17 wherein the pusher face is offset and further comprises a first edge having a top and bottom portion, and a second edge having a top and bottom portion, wherein the bottom portion of the first edge is nearer to the divider than the top portion of the first edge during operation of the system, and wherein the bottom portion of the second edge is nearer to the divider than the top portion of the second edge during operation of the system.

20. The merchandise-display system of claim 19 further comprising a front barrier designed to deter products from being pushed beyond the front barrier by the spring-urged pusher.

21. The merchandise-display system of claim 17 further comprising an end component mounted to the shelf.

22. The merchandise-display system of claim 17, wherein the base is operatively coupled to the front rail via a tongue and groove arrangement.

23. The merchandise-display system of claim 17, wherein the pusher track is operatively coupled to the front rail via a tongue and groove arrangement.

24. The merchandise-display system of claim 17, further comprising a first rail and a second rail, the elongated aperture located between the first rail and the second rail, and wherein the first rail defines a plurality of notches and the second rail defines a plurality of notches.

25. A product display system comprising:

a pusher assembly mountable to a shelf, the pusher assembly including a pusher and a track, the pusher defining a pusher face having a top and a bottom, and the track defining an elongated channel with notches, and connectors positioned beneath the notches; and a T-shaped divider for dividing displayed product into rows, the T-shaped divider including a horizontal portion and a vertical portion, the vertical portion dividing the horizontal portion into a first portion and a second portion, wherein the pusher track and at least one of the first and second portions support merchandised product, and wherein the track defines a depression near a rear portion of the track, and wherein the depression is configured to hold the pusher near the rear portion of the track in a position where the top of the pusher face is tilted toward the front rail during restocking.

26. The product display system of claim 25 wherein the pusher comprises a bottom engagement device comprising at least one flange and wherein the flange contacts the track during operation of the system.

27. The merchandise-display system of claim 25, wherein the pusher face is offset.

28. The product display system of claim 27 wherein the offset pusher face has a first edge and a second edge, the second edge having a top portion and a bottom portion, and wherein the first edge of the face is nearer to the divider than the second edge of the face during operation of the system and wherein the bottom portion of the second edge of the face is nearer to the divider than the top portion of the second edge of the face during operation of the system.

29. The product display system of claim 25, wherein the pusher assembly is operatively coupled to a rail via a tongue and groove arrangement.

30. The product display system of claim 25, wherein the divider is operatively coupled to a rail via a tongue and groove arrangement.

31. The product display system of claim 25, wherein the pusher assembly is operatively coupled to a rail via a plurality of teeth.

32. The product display system of claim 25, wherein the divider is operatively coupled to a rail via a plurality of teeth.

33. The product display system of claim 25 wherein the track defines a hole for receiving a pin for preventing the pusher from sliding out of the rear portion of the track.

34. The product display system of claim 25 wherein the track defines a breakaway portion for reducing the length of the track, and wherein the divider defines a breakaway portion for reducing the length of the divider.

35. The product display system of claim 25 further comprising at least one end finishing component mounted to the shelf.

36. A merchandise-display system comprising:

an integrated base-and-divider assembly, wherein the base-and-divider assembly includes a base portion adapted for operative coupling to a front rail, and a divider portion for dividing displayed merchandise into rows, wherein the divider portion protrudes from the base portion such that the divider portion separates the base portion into a first portion and a second portion;

a pusher track comprising at least one rail with a top surface and a bottom surface, wherein the at least one rail defines a plurality of notches, an elongated aperture adjacent to the at least one rail, connectors positioned beneath the notches, the pusher track adapted for operative coupling to the front rail; and a spring-urged pusher mounted to the pusher track for pushing merchandise toward the front of the shelf, the pusher comprising a pusher face having a top and a bottom, wherein the front rail contains a horizontal portion and a vertical portion substantially perpendicular to the horizontal portion;

wherein the base-and-divider assembly and pusher track are separate components and each are mounted to the front rail that extends along a front portion of a shelf, and wherein the pusher track includes a depression for holding the pusher near the back of the track in a shelf-stocking position, the shelf-stocking position being a position where the top of the pusher face is tilted toward the front rail.

37. A merchandise-display system comprising:

a unitary, one-piece base and divider assembly comprising a base and a divider, wherein the divider protrudes from the base and separates the base into a first portion and a second portion;

a pusher track comprising at least one rail, an elongated aperture adjacent to the at least one rail and wherein the at least one rail defines a plurality of notches wherein connectors are positioned beneath the notches;

a spring-urged pusher comprising an engagement device at a bottom portion of the pusher for engaging the pusher with the pusher track, the pusher defining a pusher face having a top and a bottom; and a coil spring connected to the pusher track, wherein the base and divider assembly and pusher track are separate components mounted to a shelf, wherein the pusher track includes a depression for holding the pusher near the back of the track in a shelf-stocking position, the shelf-stocking position being a position where the top of the pusher face is tilted toward the front rail.

38. The merchandise-display system of claim 37, wherein the base is operatively coupled to the shelf via a tongue and groove arrangement.

39. The merchandise-display system of claim 37, wherein the pusher track is operatively coupled to the shelf via a tongue and groove arrangement.

40. The merchandise-display system of claim 37, wherein the base and divider assembly and pusher track are mounted to the shelf by a front rail.

41. The merchandise-display system of claim 40, wherein the base is operatively coupled to the front rail via a tongue and groove arrangement.

42. The merchandise-display system of claim 40, wherein the pusher track is operatively coupled to the front rail via a tongue and groove arrangement.

* * * * *